US006267411B1

(12) United States Patent
Balbinot et al.

(10) Patent No.: US 6,267,411 B1
(45) Date of Patent: Jul. 31, 2001

(54) INLINE SKATE

(75) Inventors: Renzo Balbinot, Pieve di Soligo; Nicola Belli, Marghera; Mario Gonella, Conegliano; Roberto Gorza, Feltre, all of (IT)

(73) Assignee: Benetton Sportsystems S.p.A., Trevignano (IT)

( * ) Notice: Subject to any disclaimer, the term of this patent is extended or adjusted under 35 U.S.C. 154(b) by 0 days.

(21) Appl. No.: 09/166,522

(22) Filed: Oct. 6, 1998

(30) Foreign Application Priority Data

Oct. 9, 1997 (IT) ..... TV97A0137

(51) Int. Cl.[7] ..... A63C 17/26; A63C 17/06

(52) U.S. Cl. ..... 280/809; 280/11.215; 280/11.221; 280/11.224; 280/11.231; 280/11.33

(58) Field of Search ..... 280/842, 843, 280/11.19, 11.2, 11.21, 11.23, 11.22, 11.27, 11.3, 11.31, 11.32, 11.33, 605, 301, 302, 11.201, 11.204, 11.211, 11.215, 11.216, 11.217, 11.221, 11.224, 11.233, 809, 11.231

(56) References Cited

U.S. PATENT DOCUMENTS

| | | | | |
|---|---|---|---|---|
| 3,963,251 | * | 6/1976 | Miano | 280/11.3 |
| 4,021,052 | * | 5/1977 | Knowles | 280/11.2 |
| 4,166,519 | * | 9/1979 | Maloney | 280/11.2 |
| 4,817,974 | * | 4/1989 | Bergeron | 280/11.2 |
| 4,892,332 | | 1/1990 | Ryan . | |
| 5,507,506 | | 4/1996 | Geoffrey . | |
| 5,551,721 | * | 9/1996 | Renaud-Goud et al. | 280/605 |
| 5,895,061 | * | 4/1999 | Gignoux | 280/11.2 |
| 5,901,981 | * | 5/1999 | Lucht | 280/11.2 |
| 6,073,941 | * | 6/2000 | Hilgarth | 280/11.22 |

* cited by examiner

*Primary Examiner*—Lanna Mai
*Assistant Examiner*—Ruth Ilan
(74) *Attorney, Agent, or Firm*—Guido Modiano; Albert Josif; Daniel O'Byrne

(57) ABSTRACT

A skate including a frame provided with a detachable connection to a shoe and with which mutually inline wheels are associated. The skate further includes a device for temporarily supporting the single frame in a stable position when the shoe is not associated with the frame. The device can be deactivated by the engagement of the shoe with the frame, so as to allow the user to use the skate.

10 Claims, 6 Drawing Sheets

INLINE SKATE

BACKGROUND OF THE INVENTION

The present invention relates to an inline skate.

Conventional skates are constituted by a shoe, produced for example by injecting plastic material, which is associated with a usually U-shaped frame supporting a plurality of inline wheels.

The problem that has arisen regarding the use of said skates is the fact that they can be used only for skating, thus forcing the user to remove, before putting on the skates, the shoes that he usually uses for normal walking.

An inline skate marketed by the Italian company MGM under the trademark "HYPNO" is known as a partial solution to this drawback. In said skate there is a shoe which can be detached with respect to a supporting and pivoting frame for a plurality of mutually inline wheels.

An engagement element, such as a pin, is provided at the frame for a grip element which is constituted by a blade arranged below the sole of the shoe, which is locked with respect to the frame by virtue of the presence, to the rear of said frame, of an H-shaped rod whose ends are transversely pivoted to the frame at one end and are transversely pivoted, at the other end, to a lever which interacts with a suitable element associated with the shoe.

Among the various drawbacks of this type of shoe there is also, in addition to structural and constructive complexity, the fact that the user, in order to be able to associate the shoe with the frame, is forced to grip said frame so as to correctly mutually couple the base of said frame to the sole of the shoe, activating the corresponding connection means.

Likewise, if the shoe is uncoupled from the frame, the frame must be supported by the user.

Additionally, these operations occur in conditions which are not always easy for the user, and the user must in any case bend down or, also when sitting, must bend both the leg and the trunk to move his or her hands, which support the frame, toward the sole of the shoe, subsequently performing a pushing action with the foot which must be compensated by manually engaging the frame.

SUMMARY OF THE INVENTION

The aim of the present invention is to solve the above-described problems, eliminating the drawbacks of the cited prior art, by providing a skate which comprises a frame and a shoe which is detachably associated therewith and in which said connection or disconnection of the shoe with respect to the frame can be performed easily and quickly by the user.

An important object of the present invention is to provide a skate in which the user can optimally position the shoe on the frame while standing.

Another important object of the present invention is to provide a skate in which said coupling and uncoupling between the shoe and the frame can occur also if the resting surface is inclined, such as in a downhill road.

Another important object of the present invention is to provide a skate which does not require the user to perform particular movements or physical efforts to achieve optimum positioning of the shoe on the frame.

Another object of the present invention is to provide a skate which is structurally simple, reliable and safe in use.

This aim, these objects and others which will become apparent hereinafter are achieved by a skate comprising a frame provided with means for detachable connection to a shoe and with which wheels are associated, characterized in that it comprises a device for temporarily supporting said frame in a stable position which can be deactivated when said shoe is coupled to said frame.

BRIEF DESCRIPTION OF THE DRAWINGS

Further characteristics and advantages of the invention will become apparent from the following detailed description of two particular but not exclusive embodiments thereof, illustrated only by way of non-limitative example in the accompanying drawings, wherein.

DESCRIPTION OF THE PREFERRED EMBODIMENT

Figure 1:
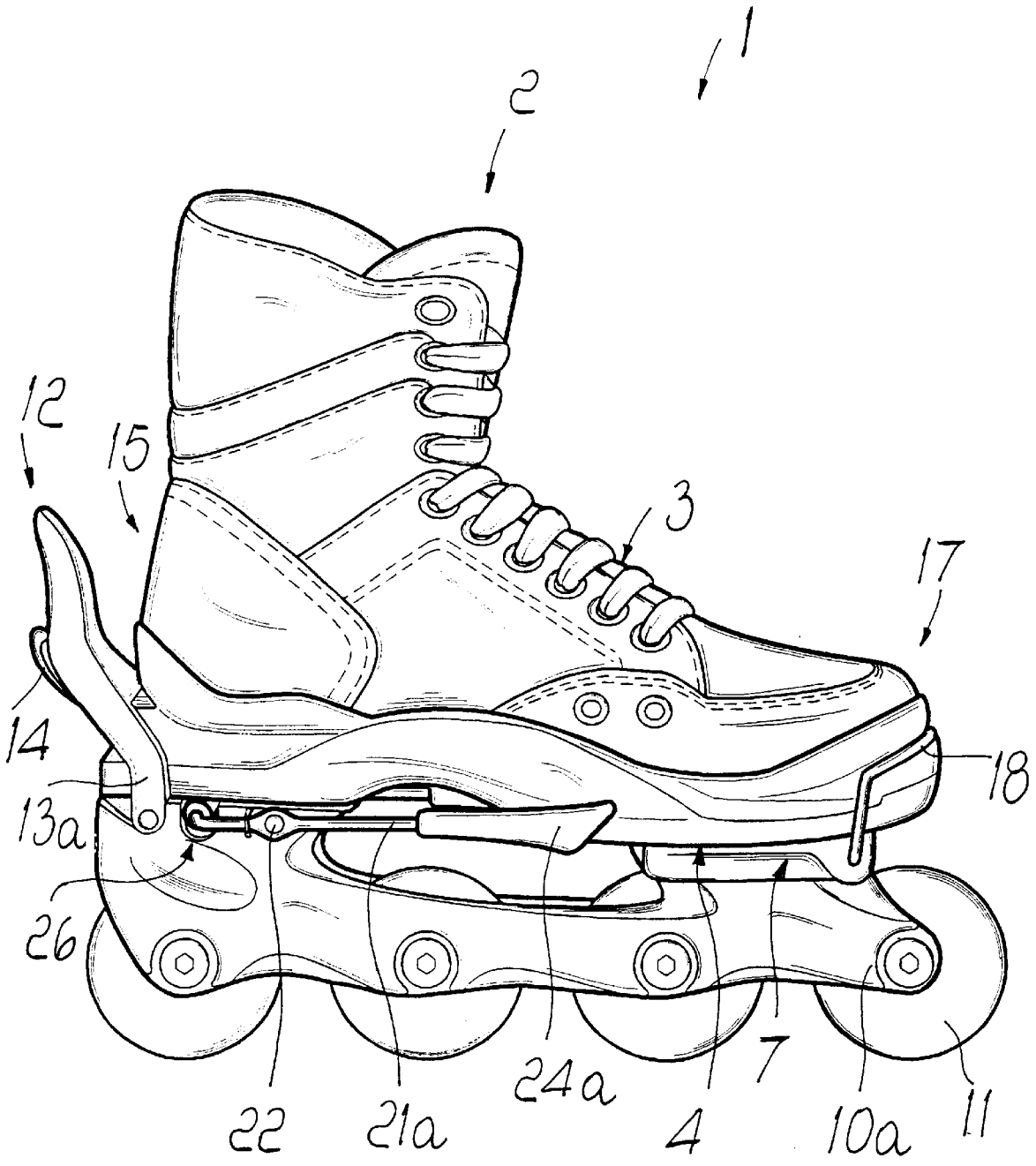
FIG. 1 is a side view of the skate with the shoe associated with the frame.
Figure 2:
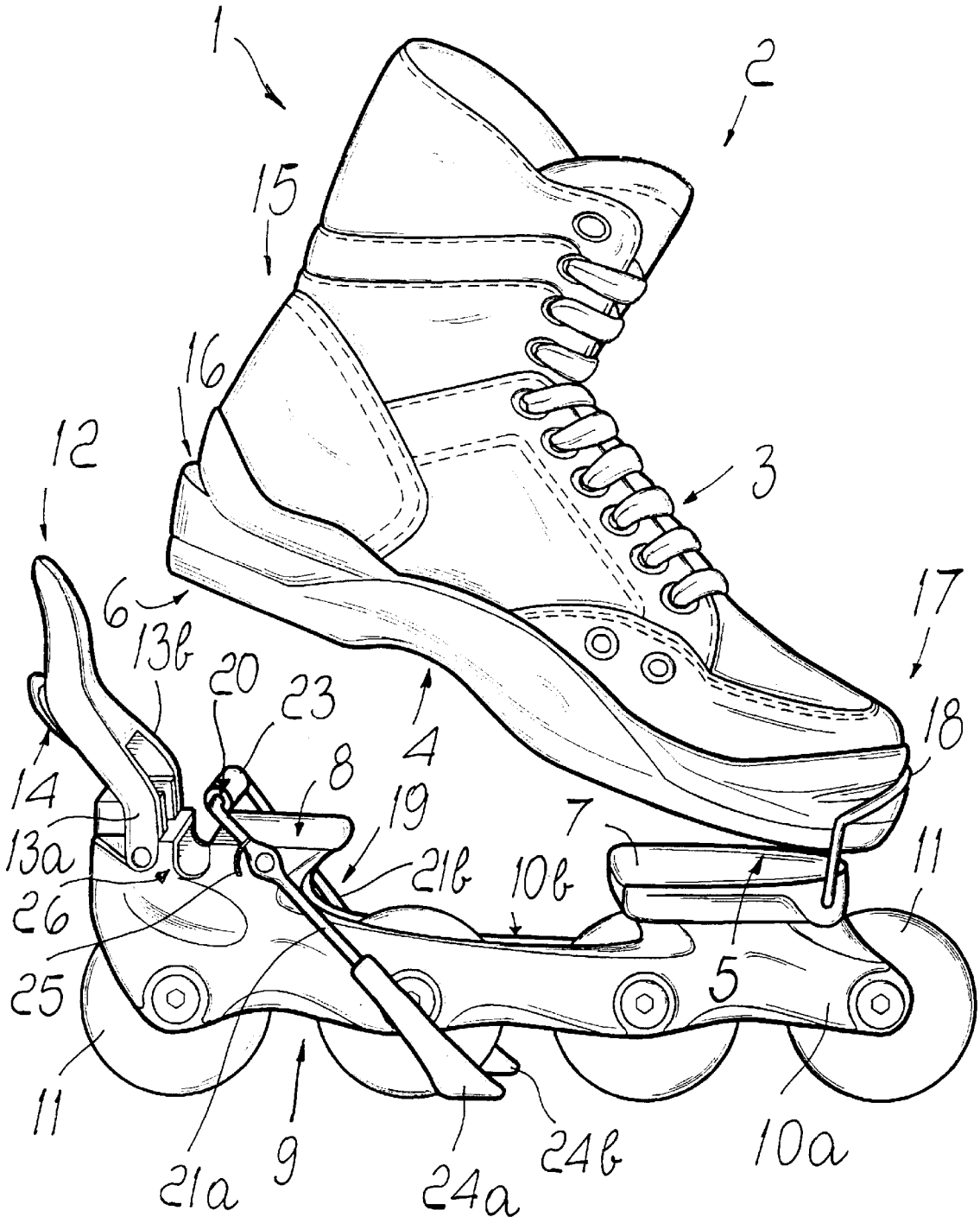
FIG. 2 is a view, similar to FIG. 1, of the condition in which the shoe and the frame are partially mutually connected.
Figure 4:
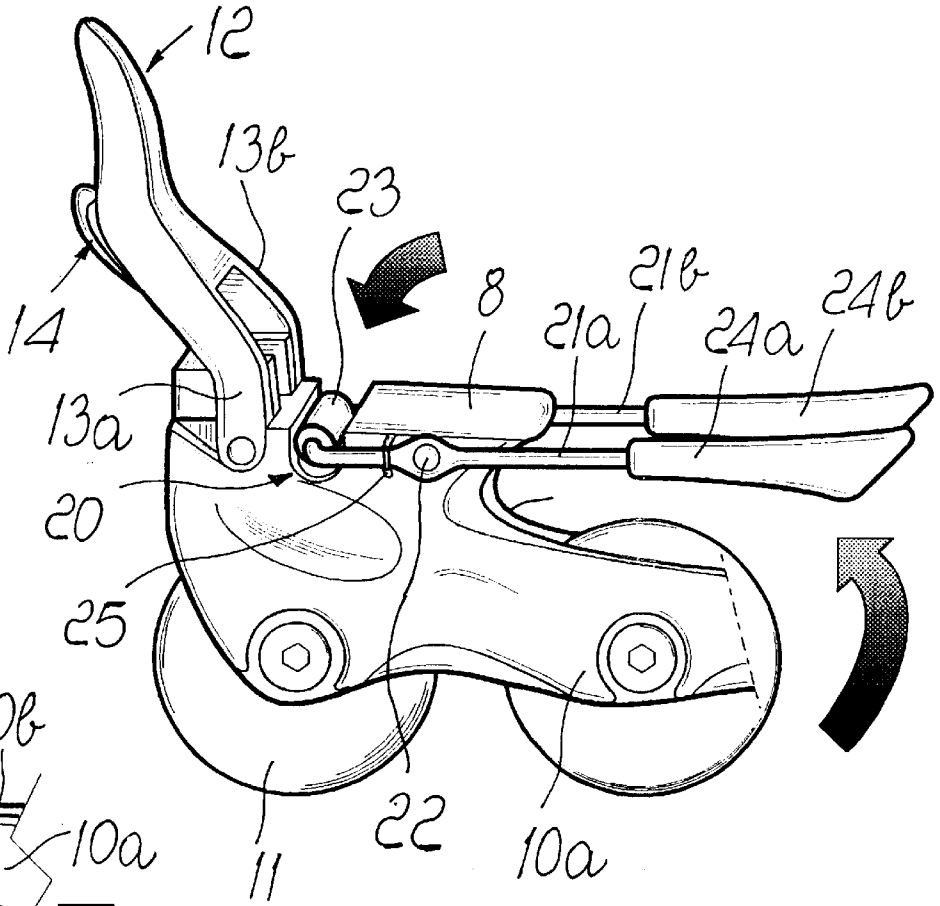
FIGS. 3 and 4 are partial views of, respectively, the activation and the deactivation of the temporary support device for the frame.
Figure 3:
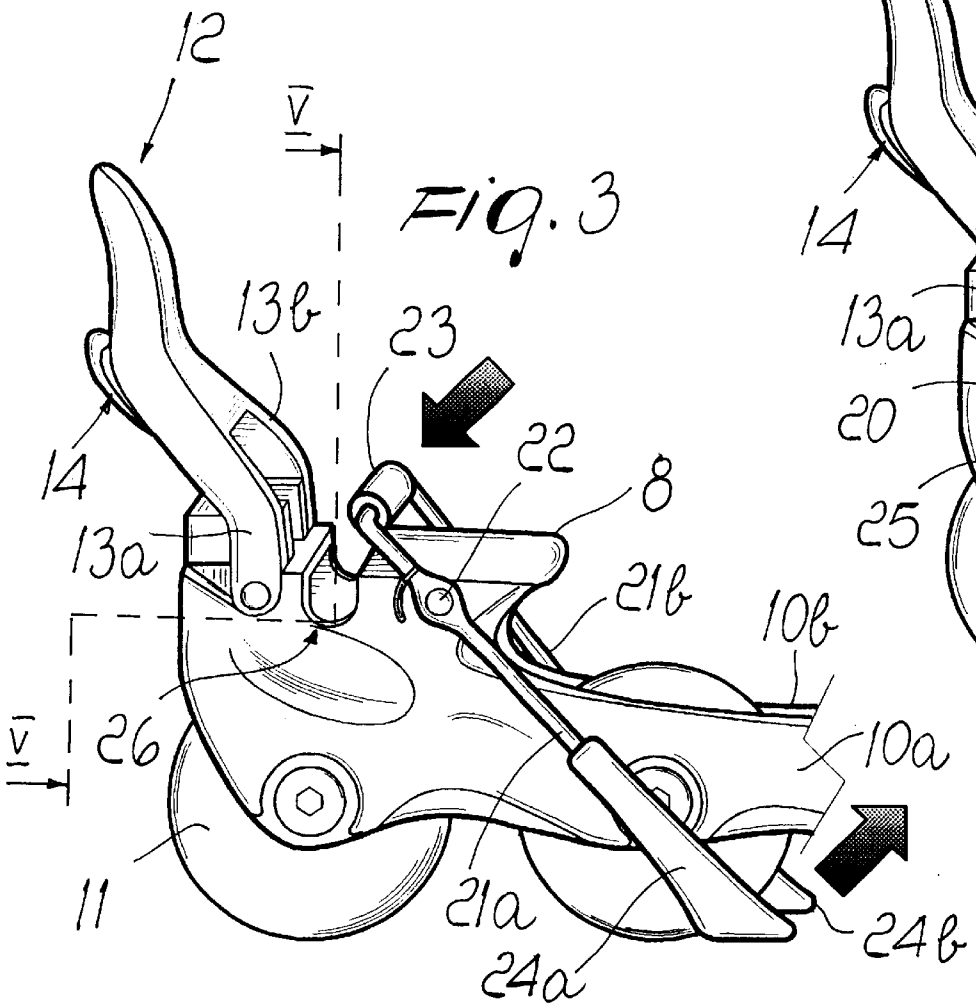
Figure 9:
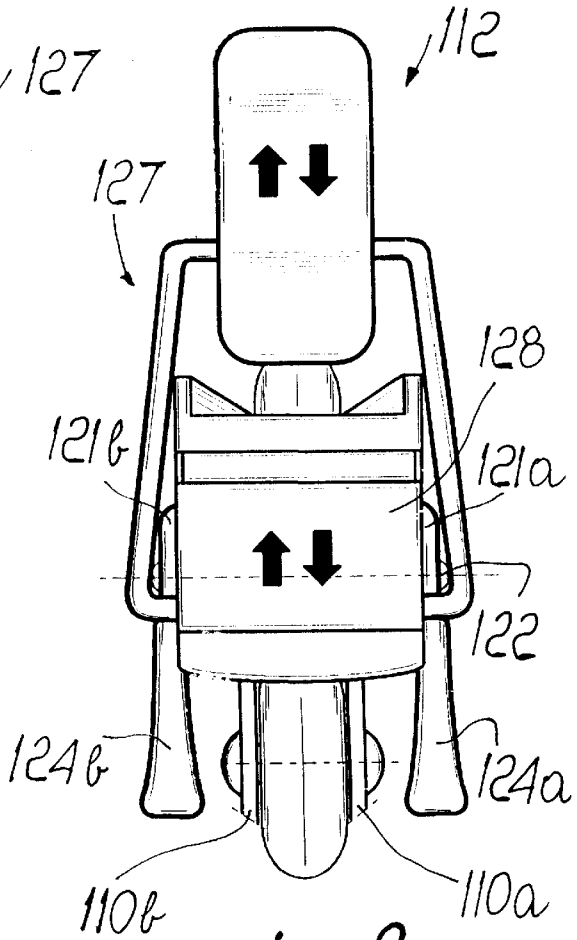
FIG. 9 is a top view of the device of FIG. 7.
Figure 8:
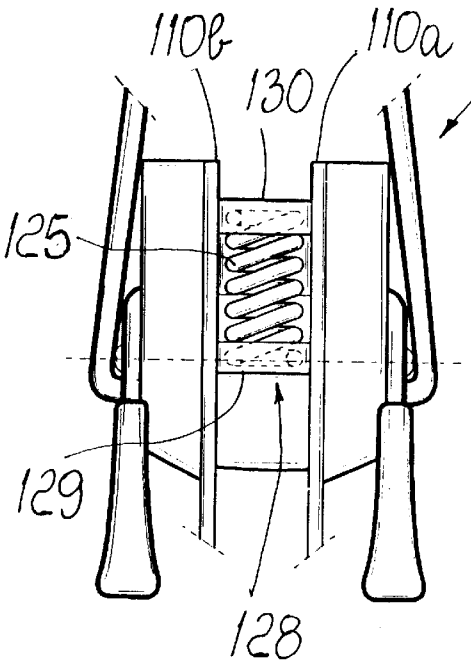
FIG. 8 is a bottom view of part of the device of FIG. 7.
Figure 5:
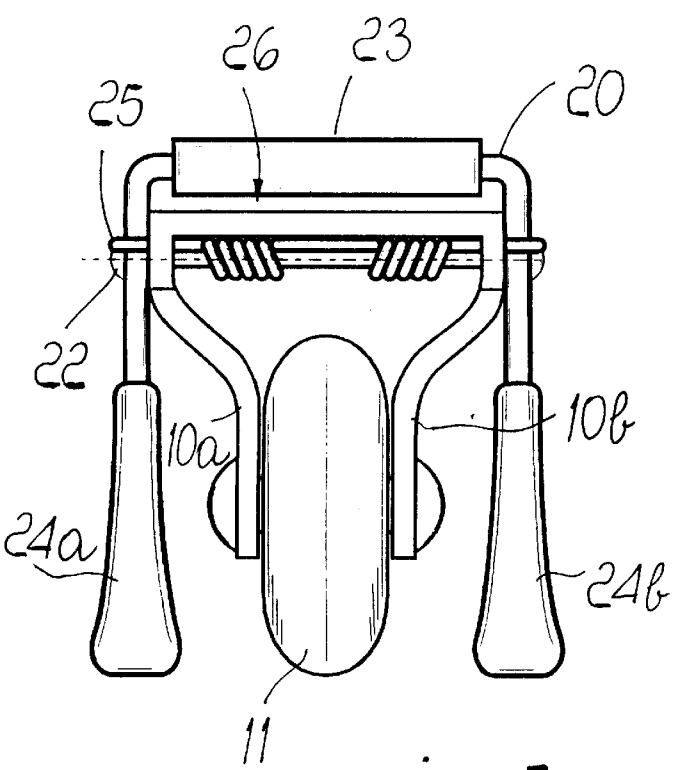
FIG. 5 is a sectional view, taken along the plane V—V of FIG. 3.
Figure 6:
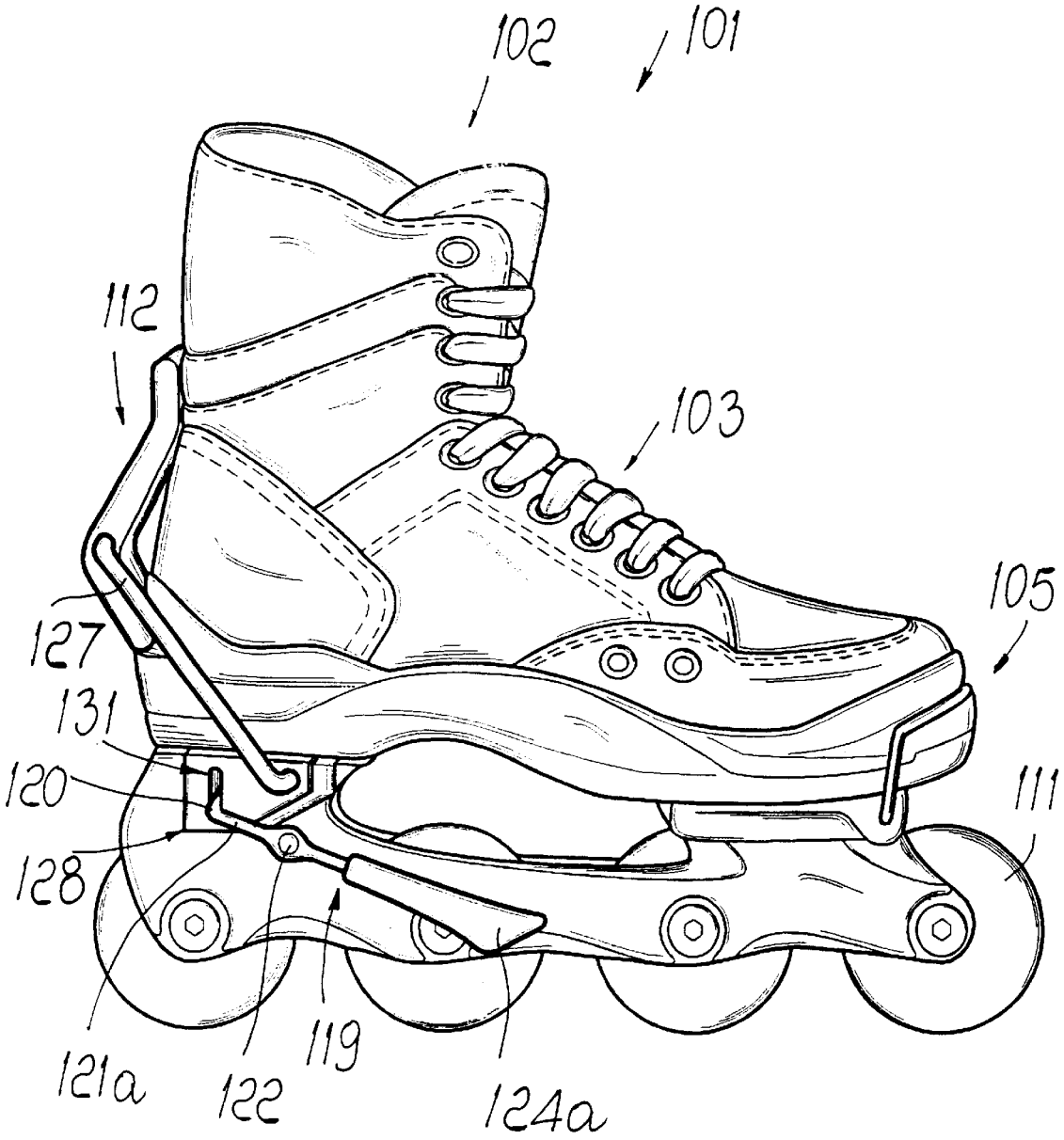
FIG. 6 is a view, similar to FIG. 1, of a second embodiment.
Figure 7:
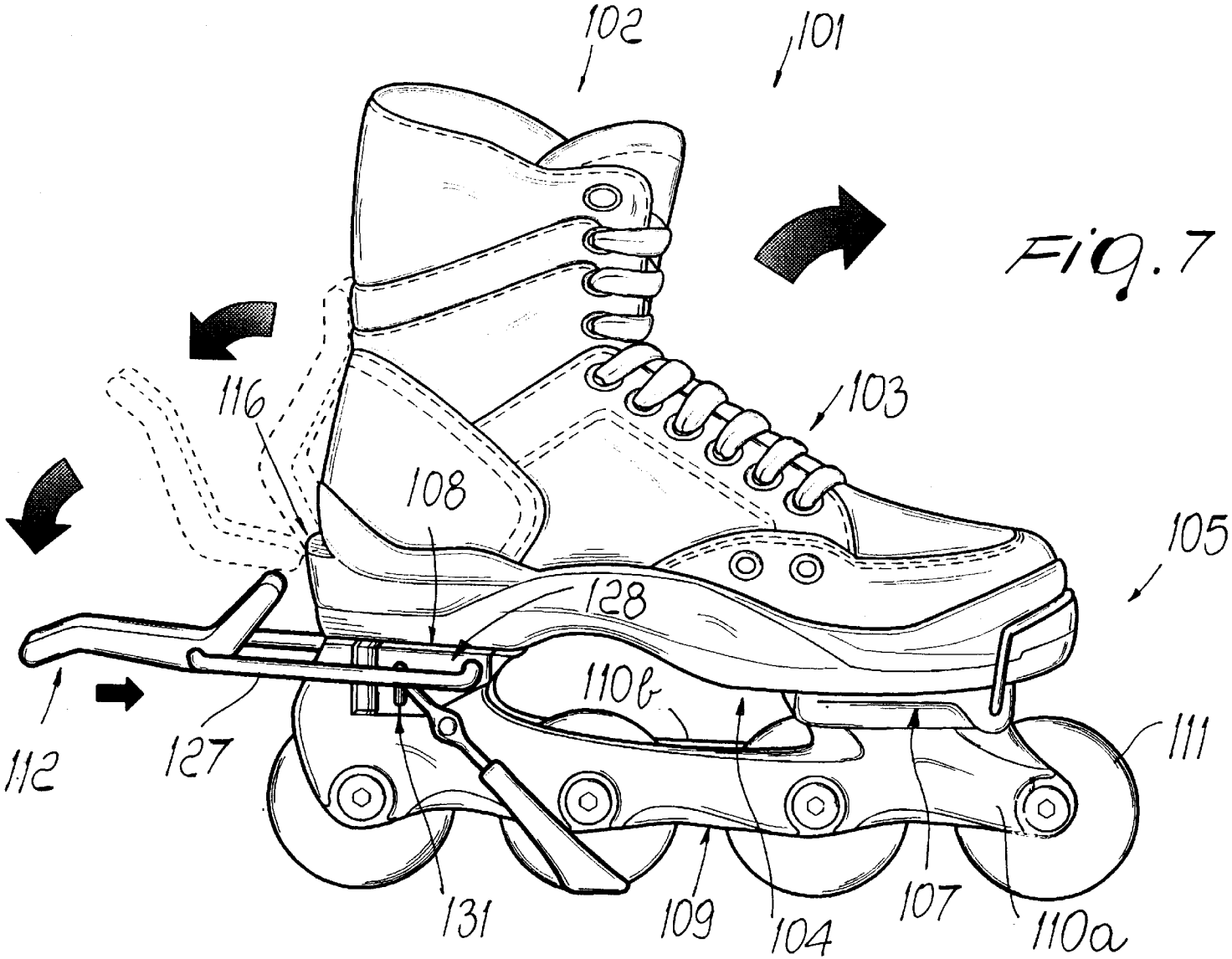
FIG. 7 is a view of the embodiment of FIG. 6 in the condition in which the temporary support device is activated.

With initial reference to the above FIGS. 1–5, 1 designates a skate comprising a shoe 2, for example of the type preferably comprising a soft upper 3 below which a sole 4 is associated.

Said sole rests, in the particular illustrated embodiment, below the toe region 5 and the heel region 6, at a first base 7 and at a second base 8 of a frame 9 which forms a pair of first wings 10*a* and 10*b* between which two or more wheels 11 are freely pivoted and are thus arranged mutually in line.

The shoe and/or the frame have suitable means for their mutual detachable coupling. Merely by way of example, FIGS. 1 to 5 show an embodiment provided with connection means disclosed in the unpublished Italian Patent Application No. TV97A000131, by this same Applicant. The connection device includes a lever 12, which has two facing free ends 13*a* and 13*b* pivoted to the rear of the second base 8 and cooperates with a torsion bar or spring 14 which is suitable to force said lever 12 toward the region 15 of the heel of the shoe and to engage at a suitable base 16 formed to the rear of the sole 4.

At the region 17 of the tip of the sole 4 there is provided a suitable seat for coupling to a fixed ring 18 which protrudes from the first base 7.

The reference numeral 19 designates the device for temporarily supporting the frame 9 in a stable position: said device is constituted, in the particular embodiment shown, by a U-shaped element which forms a third base 20 and a pair of second wings 21*a* and 21*b* which are laterally adjacent to the first wings 10*a* and 10*b* of the frame 9 and are pivoted transversely thereto by means of a suitable pivot 22 proximate to the second base 8.

A sleeve 23 is rotatably associated with the third base 20 coaxially thereto, while suitable fittings 24*a* and 24*b*, made of plastics or rubber, are associated with the free ends of the second wings 21*a* and 21*b*. The shape and length of said fittings allow optimum resting on the ground in the regions adjacent to one of said wheels.

Advantageously, the device 19 is further constituted by a spring 25 which is arranged coaxially to said pivot 22 and the ends whereof are rigidly coupled at said second wings 21*a* and 21*b*. The spring is suitable to force a clockwise rotation of the device, so as to make the fittings 24*a* and 24*b* interact with the ground when the shoe is not associated with the frame.

A seat 26 is further formed at the second base 8 and is suitable to accommodate the sleeve 23 when the shoe is associated with the frame 9.

In this condition, shown in FIG. 1, the sole interacts with the sleeve 23, forcing it into the seat 26; this produces a rotation of the second wings 21*a* and 21*b* so as to lift them with respect to the ground and place them preferably parallel to the first base 7 and to the second base 8.

It has thus been observed that the invention has achieved the intended aim and objects, a skate having been provided which comprises a device which allows to keep the frame in a stable vertical position with respect to the ground when the shoe is not associated therewith: this allows the user to quickly and easily associate the shoe with the frame while standing upright, since said frame is arranged in the optimum condition for resting the shoe thereon.

When the user disengages the shoe from the frame, the temporary support device is automatically activated into the stable position of the frame without any specific intervention on the part of the user.

The illustrated embodiment further allows the user to remove the shoe from the frame also in particularly demanding conditions, such as for example if the road slopes downhill.

The skate according to the invention is of course susceptible of numerous modifications and variations, all of which are within the scope of the same inventive concept.

Likewise, the materials and the dimensions that constitute the individual components of the device and the structure may also be the most pertinent according to specific requirements.

Thus, for example, the tips of the fittings 24*a* and 24*b* can have a conical shape or can in any case have a base whose dimensions allow to achieve optimum frame support. The location of the device can be varied according to specific requirements. The skate can further provide for the use of even more than one temporary support device, variously applied at one of the parts that constitute the frame.

FIGS. 6–9 illustrate a second embodiment for a skate 101 which is again constituted by a shoe 102 composed of an upper 103 below which a sole 104 is associated. The sole 104 can be arranged, at the tip and heel regions, on a first base 107 and on a second base 108 of a frame 109 between the first wings 110*a* and 110*b* whereof suitable wheels 111 are freely pivoted.

In the particular illustrated embodiment, the means for detachable connection between the shoe 102 and the frame 109 are constituted by a substantially L-shaped lever 112, one end of which interacts with an abutment 116 formed to the rear of the sole 104.

The lever 112 is articulated to a tension member such as a cable 127 which is associated at a plate 128 associated with the frame 109 so that it can slide along the longitudinal axis.

Said plate 128 is forced to slide toward the region 105 of the tip of the shoe by a suitable cylindrical helical compression spring 125, which is interposed between a first tooth or seat 129 and a second tooth or seat 130 formed respectively in said plate 128 and in said frame 109 in the region of the second base 108.

Slots 131 are formed at the lateral surfaces of the plate 128, preferably lie on a plane which is parallel to the plane of the first wings 110*a* and 110*b* and along the same transverse axis; the axis of said slots is arranged at right angles to the ground.

The third base 120 of the device 119 for temporarily supporting the frame in a stable position when the shoe is not associated therewith is accommodated within said slots 131.

In this case too, the device 119 comprises second wings 121*a* and 121*b* which are arranged outside the first wings 110*a* and 110*b* of the frame 109 and are pivoted thereto by means of a suitable pivot 122.

Suitable fittings 124*a* and 124*b* are associated with the tips of the second wings 121*a* and 121*b* and interact directly with the ground when the shoe is not associated with the frame.

This embodiment, too, achieves the intended aim and objects, since when the shoe is not associated with the frame the spring 125 pushes the plate 128 forward and this forces the rotation of the device 119 so that the fittings 124*a* and 124*b* interact with the ground, thus supporting the frame in a stable and vertical condition.

When the user associates the shoe with the frame, and therefore when locking occurs by means of the lever 112, the plate 128 is pulled and slides backward, simultaneously loading the spring 125 and producing, by virtue of the presence of the slots 131, the rotation of the device 119 and the lifting of the fittings 124*a* and 124*b*.

It is of course possible to provide other embodiments, for example of a simplified type in which the activation and/or deactivation of the support device occur by means of a direct manual intervention of the user on said support device.

The device can, for example, be of a telescopic type in which one end is associated with said frame and the other suitably shaped end interacts with the ground.

The disclosures in Italian Patent Application No. TV97A000137 from which this application claims priority are incorporated herein by reference.

What is claimed is:

1. A skate comprising:

a frame;

a shoe;

means for mutually detachably connecting said frame and said shoe; wheels connected to said frame;

a temporary support device for temporarily supporting said frame in a stable position which can be deactivated when said shoe is coupled to said frame, said device having a first retracted position which forms an imbalanced position for said frame and a second stable position which forms a stably balanced position for said frame;

said shoe having a soft upper below which a sole is associated, said sole resting, below toe and heel regions of said shoe, at a first base and at a second base of said frame, said frame forming two first wings between which two or more mutually inline wheels of said wheels are freely pivoted, said temporary support device comprising a U-shaped element which forms a third base and two second wings which are laterally adjacent to said first wings of said frame and are pivoted thereto by means of a pivot proximate to said second base.

2. A skate according to claim 1, therein a sleeve is rotatably and coaxially associated with said third base, and fittings are associated with free ends of said second wings, said fittings being made of plastics or rubber and having a length and shape which allow optimum resting on the ground in regions that are adjacent to one of said wheels.

3. A skate according to claim 2, further comprising a spring which is arranged coaxially to said pivot and having ends which are rigidly coupled at said second wings, said spring being adapted to force a rotation of said device so as to move said second wings or said fittings to interact with the ground when said shoe is not associated with said frame.

4. A skate according to claim 3, wherein a seat is formed at said second base and is adapted to accommodate said third base or said sleeve when said shoe is associated with said frame.

5. A skate according to claim 4, wherein when said shoe is associated with said frame said sole interacts with said third base or with said sleeve, forcing said third base and said sleeve into said seat and making said second wings rotate so as to lift said second wings with respect to the ground.

6. A skate according to claim 1, wherein said means for mutually detachably connecting said shoe and said frame comprises a lever which is articulated to a tension member or cable which can be tensioned by said lever, said tension member or cable being associated at a plate which is in turn associated with said frame so that said plate can slide along a longitudinal axis of said frame.

7. A skate according to claim 6, wherein said plate is forced to slide toward the toe region of said shoe by means of at least one cylindrical helical compression spring which is interposed between a first tooth or seat formed in said plate, and a second tooth or seat formed in said frame.

8. A skate according to claim 7, wherein said first tooth or seat and said second teeth or seat are formed in a region of said second base.

9. A skate according to claim 7, wherein slots are formed transversely at lateral surfaces of said plate and lie on a plane which is parallel to a plane of said first wings, an axis of said slots being approximately perpendicular to the ground.

10. A skate according to claim 9, wherein said slots accommodate said third base of said U-shaped element of said temporary support device.

* * * * *